US010908540B1

(12) United States Patent
Watanabe

(10) Patent No.: US 10,908,540 B1
(45) Date of Patent: Feb. 2, 2021

(54) FIXING DEVICE AND IMAGE FORMING APPARATUS

(71) Applicant: TOSHIBA TEC KABUSHIKI KAISHA, Tokyo (JP)

(72) Inventor: Takaho Watanabe, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/791,744

(22) Filed: Feb. 14, 2020

(51) Int. Cl.
*G03G 15/20* (2006.01)

(52) U.S. Cl.
CPC ..... *G03G 15/2025* (2013.01)

(58) Field of Classification Search
CPC ..... G03G 15/2025
See application file for complete search history.

(56) References Cited

U.S. PATENT DOCUMENTS

2008/0232868 A1 9/2008 Ishino
2009/0014942 A1 1/2009 Okuno
2011/0052245 A1* 3/2011 Shinshi ..... G03G 15/2025 399/92
2013/0236219 A1* 9/2013 Matsumoto ..... G03G 15/2053 399/327
2015/0198919 A1* 7/2015 Lee ..... G03G 15/2025 399/329
2018/0081310 A1* 3/2018 Tsubotani ..... G03G 15/2053
2019/0265617 A1* 8/2019 Kataoka ..... G03G 15/2025

FOREIGN PATENT DOCUMENTS

JP 2004-029607 A 1/2004

* cited by examiner

*Primary Examiner* — Sandra Brase
(74) *Attorney, Agent, or Firm* — Foley & Lardner LLP

(57) ABSTRACT

A fixing device fixes a toner image to a medium conveyed in a conveying direction, the toner image formed on the medium, the fixing device including a heating rotating body, a heater, a pressing member, a pressing rotating body, and a lubricant holding member. The heater heats the heating rotating body, which is supported to be rotatable. The pressing member is disposed inside the heating rotating body. The pressing rotating body is pressed against the pressing member through the heating rotating body to form a nip through which the medium passes. The lubricant holding member has an abutting surface that abuts against an inner circumferential surface of the heating rotating body, and the abutting surface includes a first region filled with a first lubricant and a second region filled with a second lubricant.

16 Claims, 9 Drawing Sheets

FIXING DEVICE AND IMAGE FORMING APPARATUS

FIELD

Embodiments described herein relate generally to a fixing device and an image forming apparatus.

BACKGROUND

An image forming apparatus such as a multi-function peripheral or a laser printer includes a fixing device for fixing a toner image to paper. For example, the fixing device transfers heat from a heater to paper through a fixing belt such that a toner image transferred to the paper is fixed to the paper. As a result, printing of an image, a character, or the like on paper is implemented.

In this fixing device, a pressing roller is pressed against a pressing pad through a fixing belt such that a nip through which paper passes is formed between the fixing belt and the pressing roller, the pressing pad being disposed inside the fixing belt. Therefore, when the fixing belt and the pressing roller rotate when paper passes through the nip, an inner circumferential surface of the fixing belt slides along the pressing pad. Therefore, a lubricant such as silicone oil is applied to the inner circumferential surface of the fixing belt. As a result, the friction resistance of the fixing belt is reduced.

However, the silicone oil can leak from an end portion of the fixing belt or evaporate when the fixing belt is heated such that the amount of the silicone oil is reduced. As a result, sliding properties of the fixing belt gradually deteriorate along with the operation of the device. Therefore, various techniques of supplying the lubricant to the inner circumferential surface of the fixing belt even during the operation of the device to suppress deterioration in the sliding properties of the fixing belt are disclosed.

In the related art, the lubricant is applied to the inner circumferential surface of the fixing belt by a lubricant holding member. Therefore, deterioration of the sliding properties of the fixing belt can be suppressed. However, when the lubricant is heated, the viscosity thereof deteriorates, and the lubricant is likely to leak from the inner circumferential surface of the fixing belt to the outside. Therefore, when the operating time of the fixing device increases, the amount of lubricant may become insufficient. In addition, when a grease or the like having a high viscosity is used as the lubricant, the outflow of the lubricant can be suppressed. However, there is a problem in that the viscous resistance increases and sliding properties deteriorate.

DETAILED DESCRIPTION

In general, according to one embodiment, a fixing device is a device that fixes a toner image to a medium conveyed in a conveying direction, the toner image being formed on the medium, the fixing device including a heating rotating body (e.g., a fixing belt), a heater, a pressing member (e.g., a pressing pad), a pressing rotating body (e.g., a pressing roller), and a lubricant holding member (holder). The heating rotating body is supported to be rotatable. The heater heats the heating rotating body. The pressing member is disposed inside the heating rotating body. The pressing rotating body is configured to be pressed against the pressing member through the heating rotating body to form a nip through which the medium passes. The lubricant holding member has an abutting surface that abuts against an inner circumferential surface of the heating rotating body. The abutting surface includes a first region to which a first lubricant having a first viscosity is added and a second region to which a second lubricant having a second viscosity that is higher than the first viscosity is added.

Hereinafter, an image forming apparatus (e.g., a printer, copier, fax machine or the like) according to an embodiment will be described with reference to the drawings. In the description, an XYZ coordinate system including an X-axis, a Y-axis, and a Z-axis perpendicular to each other is appropriately used.

Figure 1:
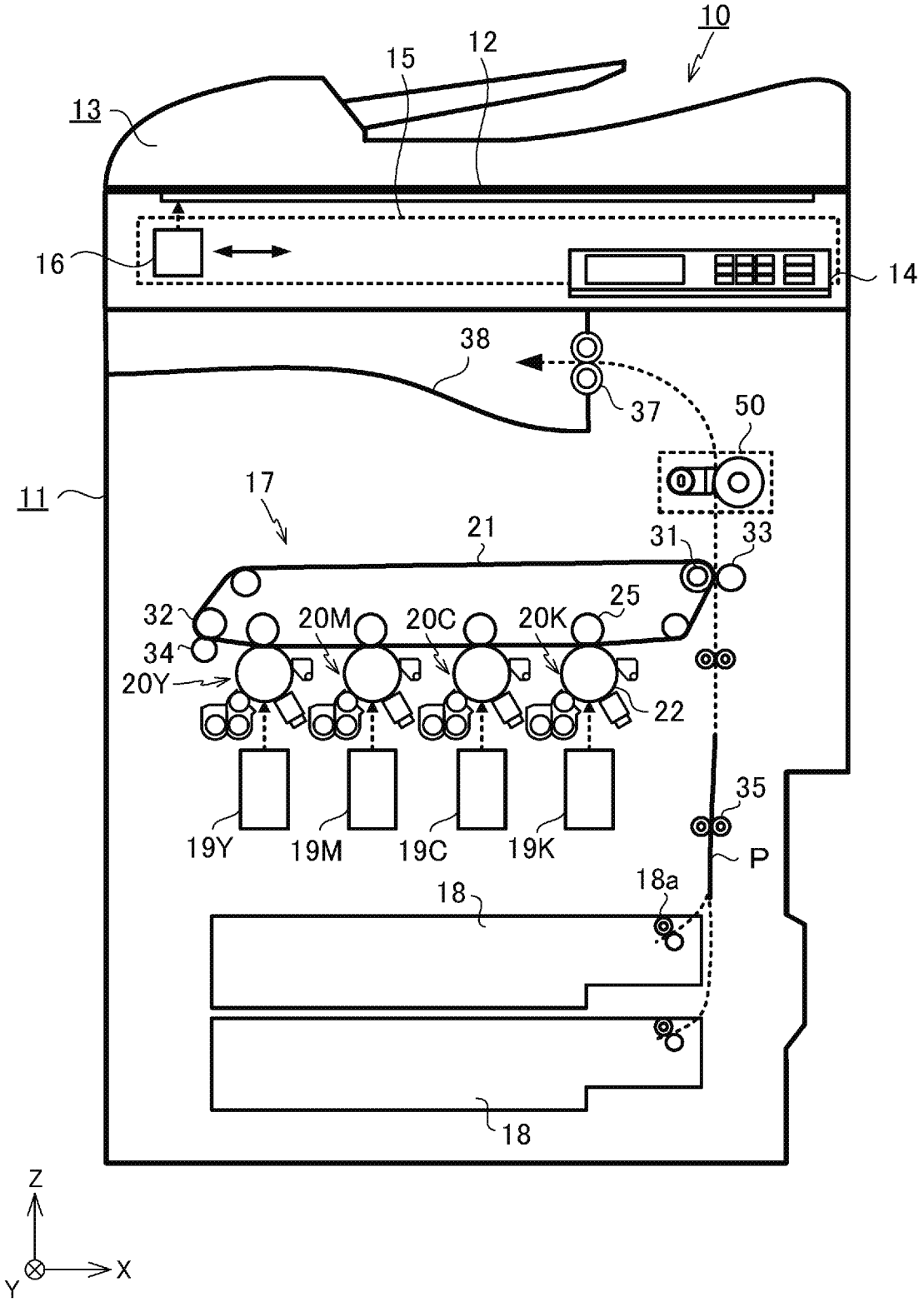
FIG. 1 is a diagram schematically illustrating a configuration of an image forming apparatus according to an embodiment.

FIG. 1 is a diagram schematically illustrating a configuration of an image forming apparatus 10 according to the embodiment. The image forming apparatus 10 is, for example, multi-function peripheral (MFP). The image forming apparatus 10 includes a main body portion 11 and an automatic document feeder (ADF) 13 that is disposed above the main body portion 11. The document tray 12 is formed of transparent glass and is disposed above the main body portion 11, and the automatic document feeder (ADF) 13 is pivotably provided on an upper surface side of the document tray 12. In addition, an operation panel 14 is provided above the main body portion 11. The operation panel 14 includes various keys and a graphical user interface (GUI).

A scanner 15 for reading an original document is provided below the document tray 12. The scanner 15 reads an original document conveyed from the automatic document feeder 13 or an original document placed on the document tray 12 to generate image data. The scanner 15 includes an image sensor 16.

When reading an image of an original document placed on the document tray 12, the image sensor 16 reads the image of the original document while moving along the document tray 12 in a +X direction. In addition, when reading an image of an original document supplied from the automatic document feeder 13 to the document tray 12, the image sensor 16 is fixed at a position illustrated in FIG. 1 and reads an image of each of original documents that are sequentially conveyed.

In the main body portion 11, an image forming unit 17 is disposed. The image forming unit 17 forms a toner image on a recording medium such as paper accommodated in a paper feed cassette 18 based on image data read by the scanner 15 or image data generated by a personal computer or the like.

The image forming unit 17 includes: image forming units 20Y, 20M, 20C, and 20K that form latent images using toners of yellow (Y), magenta (M), cyan (C), and black (K); scanning heads 19Y, 19M, 19C, and 19K corresponding to the image forming units; and an intermediate transfer belt 21.

The image forming units 20Y, 20M, 20C, and 20K are positioned below the intermediate transfer belt 21. In the image forming unit 17, the image forming units 20Y, 20M, 20C, and 20K are arranged from a −X side to a +X side. The scanning heads 19Y, 19M, 19C, and 19K are disposed above the image forming units 20Y, 20M, 20C, and 20K, respectively.

Figure 2:
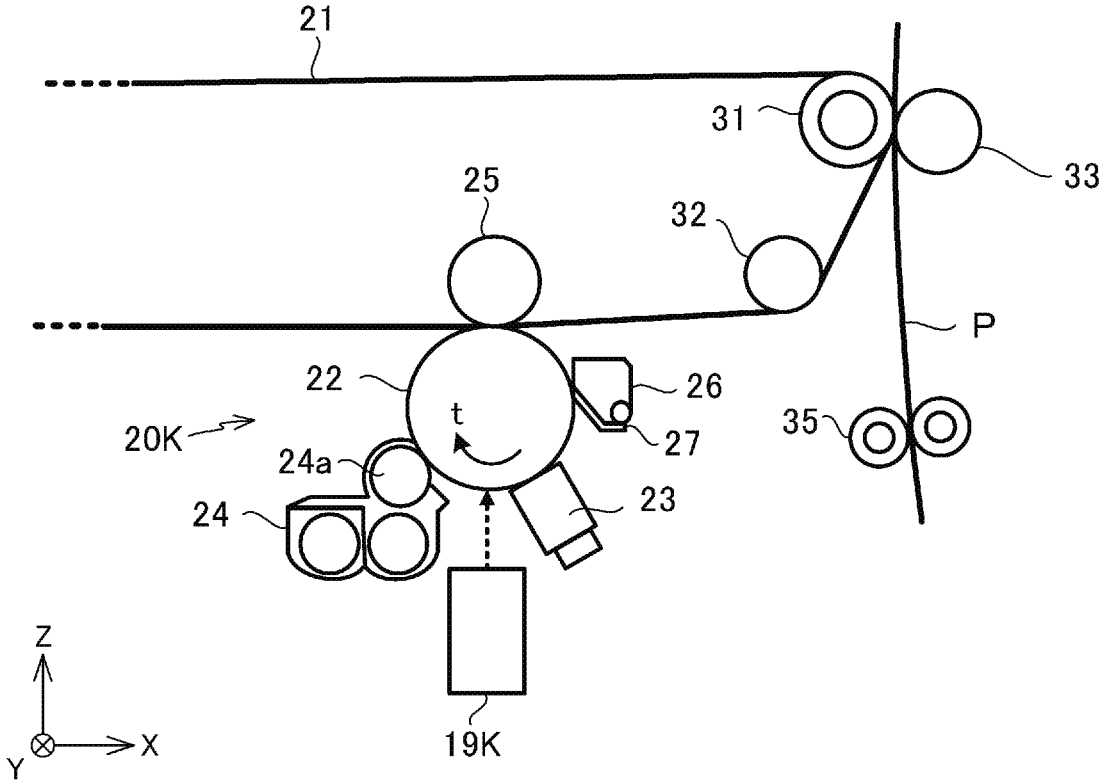
FIG. 2 is an enlarged view illustrating an image forming unit.

FIG. 2 is an enlarged illustration of the image forming unit 20K among the image forming units 20Y, 20M, 20C, and 20K. The respective image forming units 20Y, 20M, 20C, and 20K have the same configuration. Therefore, the configuration of each of the image forming units will be described using the image forming unit 20K as an example.

The image forming unit 20K includes a photoconductive drum 22 as an image carrier. In the vicinity of the photoconductive drum 22, an electrostatic charger 23, a developing unit 24, a primary transfer roller 25, a cleaner 26, and the like are disposed along a direction indicated by an arrow t. An exposure position of the photoconductive drum 22 is irradiated with laser light emitted from the scanning head 19K. By irradiating a surface of the photoconductive drum 22 that is rotating with laser light, an electrostatic latent image is formed on the surface of the photoconductive drum 22.

The electrostatic charger 23 of the image forming unit 20K uniformly charges the surface of the photoconductive drum 22. The developing unit 24 (e.g., developer) develops the electrostatic latent image by supplying the toner to the photoconductive drum 22 using a developing roller 24*a* to which a developing bias is applied. The cleaner 26 releases and removes residual toner on the surface of the photoconductive drum 22 using a blade 27. The toner released by the blade 27 is collected by the cleaner 26.

As illustrated in FIG. 1, the intermediate transfer belt 21 is suspended by a driving roller 31 and three driven rollers 32. The intermediate transfer belt 21 rotates to the left in FIG. 1 by the driving roller 31 rotating. In addition, as illustrated in FIG. 1, the intermediate transfer belt 21 is in contact with an upper surface of each of the photoconductive drums 22 of the image forming units 20Y, 20M, 20C, and 20K. A primary transfer voltage is applied to a position of the intermediate transfer belt 21 facing the photoconductive drum 22 by the primary transfer roller 25. As a result, the toner image developed on the surface of the photoconductive drum 22 is primarily transferred to the intermediate transfer belt 21.

A secondary transfer roller 33 is disposed to face the driving roller 31 that suspends the intermediate transfer belt 21. When paper P passes through a gap between the driving roller 31 and the secondary transfer roller 33, a secondary transfer voltage is applied to the paper P by the secondary transfer roller 33. As a result, the toner image formed on the intermediate transfer belt 21 is secondarily transferred to the paper P. In the vicinity of the driven roller 32 of the intermediate transfer belt 21, a belt cleaner 34 is provided as illustrated in FIG. 1. Residual toner on the surface of the intermediate transfer belt 21 is removed by the belt cleaner 34.

As illustrated in FIG. 1, a paper feed roller 35 is provided between the paper feed cassette 18 and the secondary transfer roller 33. The paper P that is picked up from the paper feed cassette 18 by a pickup roller 18*a* disposed in the vicinity of the paper feed cassette 18 is conveyed to a gap between the intermediate transfer belt 21 and the secondary transfer roller 33 by the paper feed roller 35.

A fixing device 50 is provided above the secondary transfer roller 33. In addition, a paper discharge roller 37 is provided above the fixing device 50. The paper P having passed through the intermediate transfer belt 21 and the secondary transfer roller 33 is heated by the fixing device 50. As a result, the toner image is fixed to the paper P. The paper P having passed through the fixing device 50 is discharged to a paper discharge unit 38 by the paper discharge roller 37.

Figure 3:
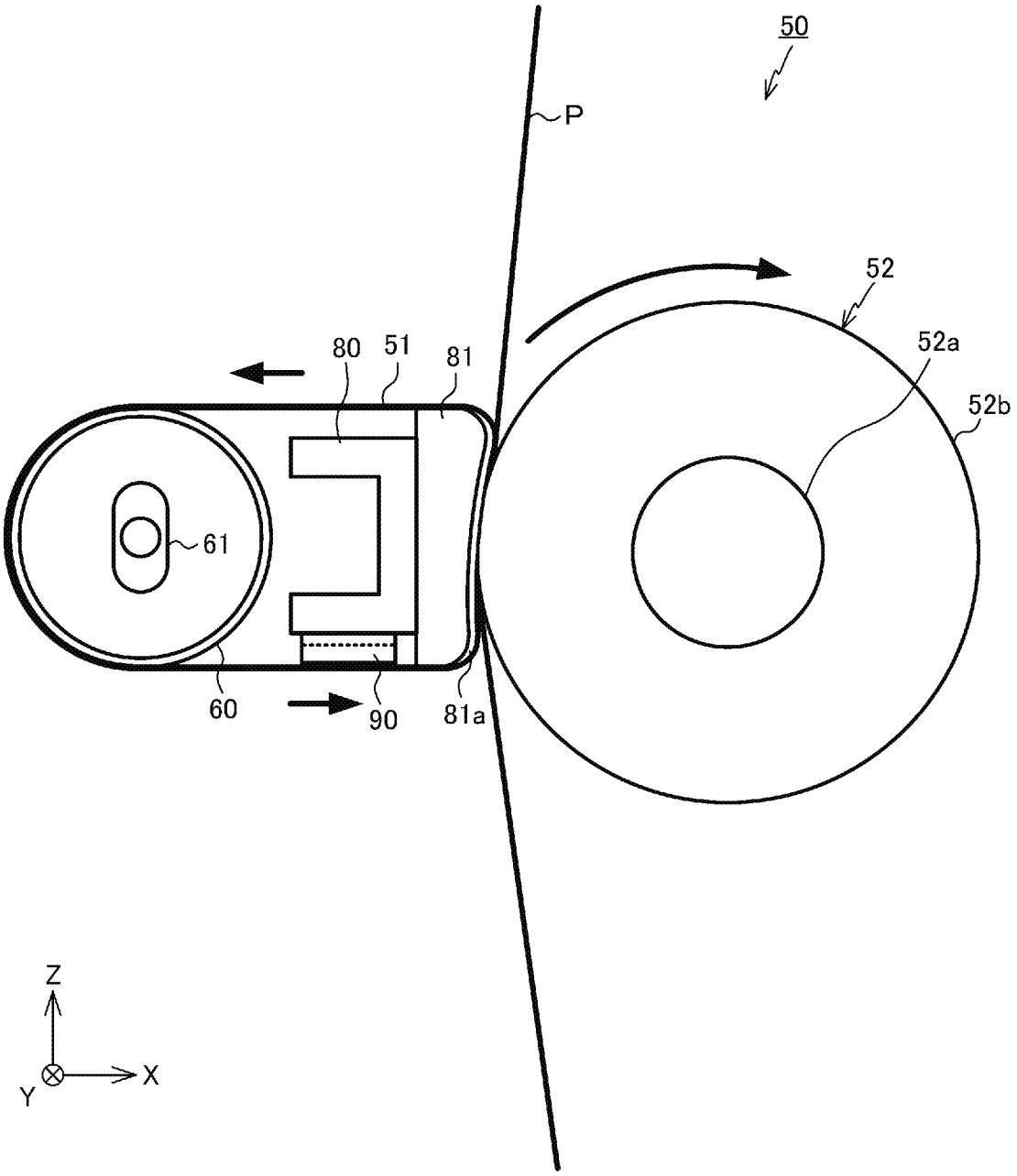
FIG. 3 is a diagram illustrating an example of a fixing device.

FIG. 3 is a diagram illustrating an example of the fixing device 50. For example, the fixing device 50 includes a heating roller 60, abase member 80, a pressing pad 81 that is supported by the base member 80, a fixing belt 51 that is wound around the heating roller 60 and the pressing pad 81, a pressing roller 52, and a lubricant holding member 90.

Figure 4:
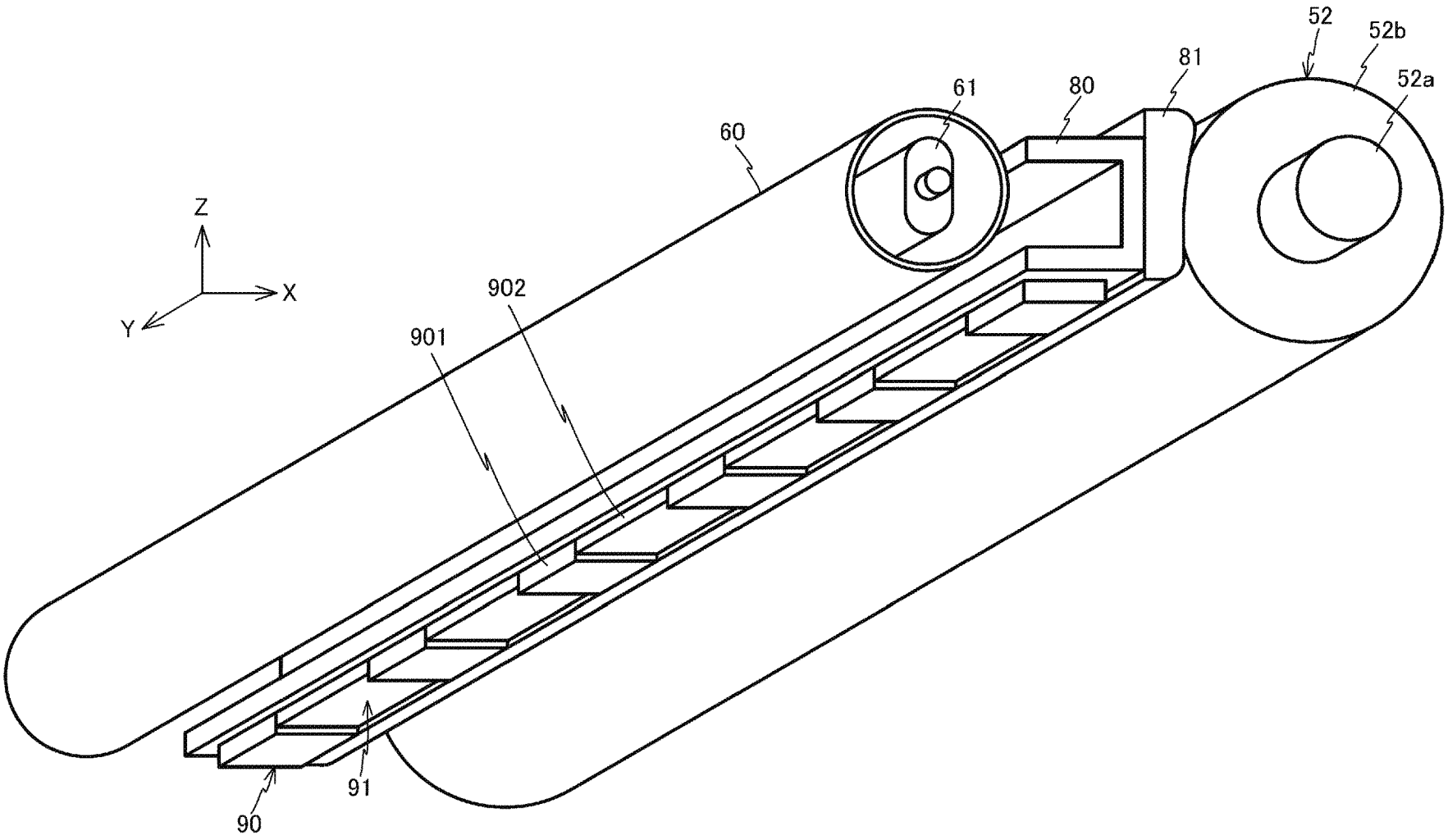
FIG. 4 is a perspective view illustrating the fixing device in a state where a fixing belt is not illustrated.

FIG. 4 is a perspective view illustrating the fixing device 50 illustrated in FIG. 3 in a state where the fixing belt 51 is not illustrated. The heating roller 60 is a cylindrical member in which a longitudinal direction is a Y-axis direction. The heating roller 60 has a length of about 35 cm and a diameter of about 20 mm and is formed of a metal having a high thermal conductivity, for example, aluminum. The heating roller 60 is supported to be rotatable about an axis parallel to the Y-axis, for example, through a one-way gear. Therefore, a rotation direction of the heating roller 60 is limited to the left in FIG. 3. As illustrated in FIG. 4, for example, a halogen heater 61 is disposed inside the heating roller 60. The halogen heater 61 is substantially equal to the length of the heating roller 60 in the Y-axis direction.

The base member 80 is a member that extends longitudinally in a Y-axis direction and has an XZ cross-section of a U-shape. The base member 80 is formed of, for example, iron or stainless steel. The base member 80 has substantially the same length as the heating roller 60 and is horizontally supported so as to be parallel to the Y-axis.

The pressing pad 81 is a member that extends longitudinally in the Y-axis direction. The pressing pad 81 has the same length as that of the heating roller 60 and is formed of, for example, an elastic material such as silicone rubber or fluorine rubber or a heat resistant resin such as a polyimide resin, a polyphenylene sulfide resin (PPS), polyether sulfone (PES), a liquid crystal polymer (LCP), or a phenol resin (PF). For example, as illustrated in FIG. 3, a sliding sheet 81*a* having a low friction resistance that covers a surface of the pressing pad 81 may be provided on the surface of the pressing pad 81.

The sliding sheet 81*a*, for example, can be polytetrafluoroethylene (PTFE) or glass cloth impregnated with a fluororesin. A sheet having a thickness of 0.2 mm and a single-layer structure formed of polytetrafluoroethylene can also be used as sliding sheet 81*a*.

The fixing belt 51 is an annular belt having a cylindrical shape that extends longitudinally in the Y-axis direction. The length of the fixing belt 51 in the Y-axis direction is substantially equal to the length of the heating roller 60 and is more than the width of the paper P (the dimension in the Y-axis direction). The fixing belt 51 is supported by the heating roller 60 and the pressing pad 81. When the heating roller 60 is biased in a −X direction, the fixing belt 51 is suspended by a constant tensile force.

The fixing belt 51 has a thickness of about 300 μm. A base of the fixing belt 51 is a film formed of, for example, polyimide having heat resistance and a thickness of 70 μm.

In some embodiments, a metal layer, a composite functional layer, an elastic layer, and a protective layer are laminated on a surface of the base.

The metal layer is a layer formed of metal such as copper or SUS, and the composite functional layer is a layer formed of nickel. The elastic layer is a layer having a thickness of about 200 μm and formed of silicone rubber. The elastic layer is covered with the protective layer formed of a perfluoroalkoxy resin (PFA resin). In order to reduce the warm-up time of the fixing device 50, the thicknesses of the elastic layer and the protective layer are adjusted such that the thermal capacity does not increase excessively. Silicone oil as a lubricant is applied to an inner circumferential surface of the fixing belt 51.

As illustrated in FIG. 4, the pressing roller 52 is a cylindrical member in which a longitudinal direction is the Y-axis direction. The pressing roller 52 includes a core 52*a* formed of a metal such as aluminum and a silicone rubber layer 52*b* laminated on an outer circumferential surface of the core 52*a*. A surface of the silicone rubber layer 52*b* is covered with a perfluoroalkoxy resin (PFA resin). In some embodiments, the pressing roller 52 has an outer diameter of about 30 mm and a length that is substantially equal to the width of the fixing belt 51.

The pressing roller 52 supports the core 52*a* such that the core 52*a* is rotatable about the center of the roller, and is biased to the −X direction by, for example, an elastic force of a spring. As a result, the pressing roller 52 abuts against the pressing pad 81 through the fixing belt 51. The pressing roller 52 abuts against the pressing pad 81 through the fixing belt 51 such that a nip through which the paper P passes is formed between the pressing roller 52 and the fixing belt 51. In addition, when the paper P is a thick medium such as an envelope, the pressing roller 52 is positioned to be spaced from the fixing belt 51 by a distance corresponding to the thickness of the paper P.

The lubricant holding member 90 is a member impregnated with a lubricant and includes two kinds of holding sheets 901 and 902 having different thicknesses. In some embodiments, the lubricant holding member 90 includes six holding sheets 901 (six first holding portions) and five holding sheets 902 (five second holding portions). The numbers of the holding sheets 901 and 902 are determined depending on the size of the paper P used in the image forming apparatus 10.

The holding sheets 901 and 902 have a rectangular shape, and the lengths in the X-axis direction are, for example, about 1 cm to 2 cm. The length of the holding sheet 901 in the Y-axis direction is, for example, about 2 cm, and the length of the holding sheet 902 in the Y-axis direction is, for example, about 3 cm to 4 cm. In addition, the thickness of the holding sheet 901 is, for example, about 3 mm, and the thickness of the holding sheet 902 is, for example, about 2 mm, such that the holding sheet 902 is thinner than the holding sheet 901. The holding sheets 901 and 902 are formed of an elastically deformable material having liquid absorbing properties. The lubricant holding member 90 is formed of, for example, a material having liquid absorbing properties and high heat resistance such as aramid fibers, a melamine resin, or glass fibers.

The lubricant holding member 90 is formed when the six holding sheets 901 and the five holding sheets 902 are bonded to a lower surface (surface on the −Z side) of the base member 80 via an adhesive or the like in a state where they are alternately arranged in the Y-axis direction. In the lubricant holding member 90, a portion formed by the holding sheet 902 becomes a recessed portion 91 that is recessed toward the −Z side. The depth of the recessed portion 91 is about 1 mm.

Figure 5:
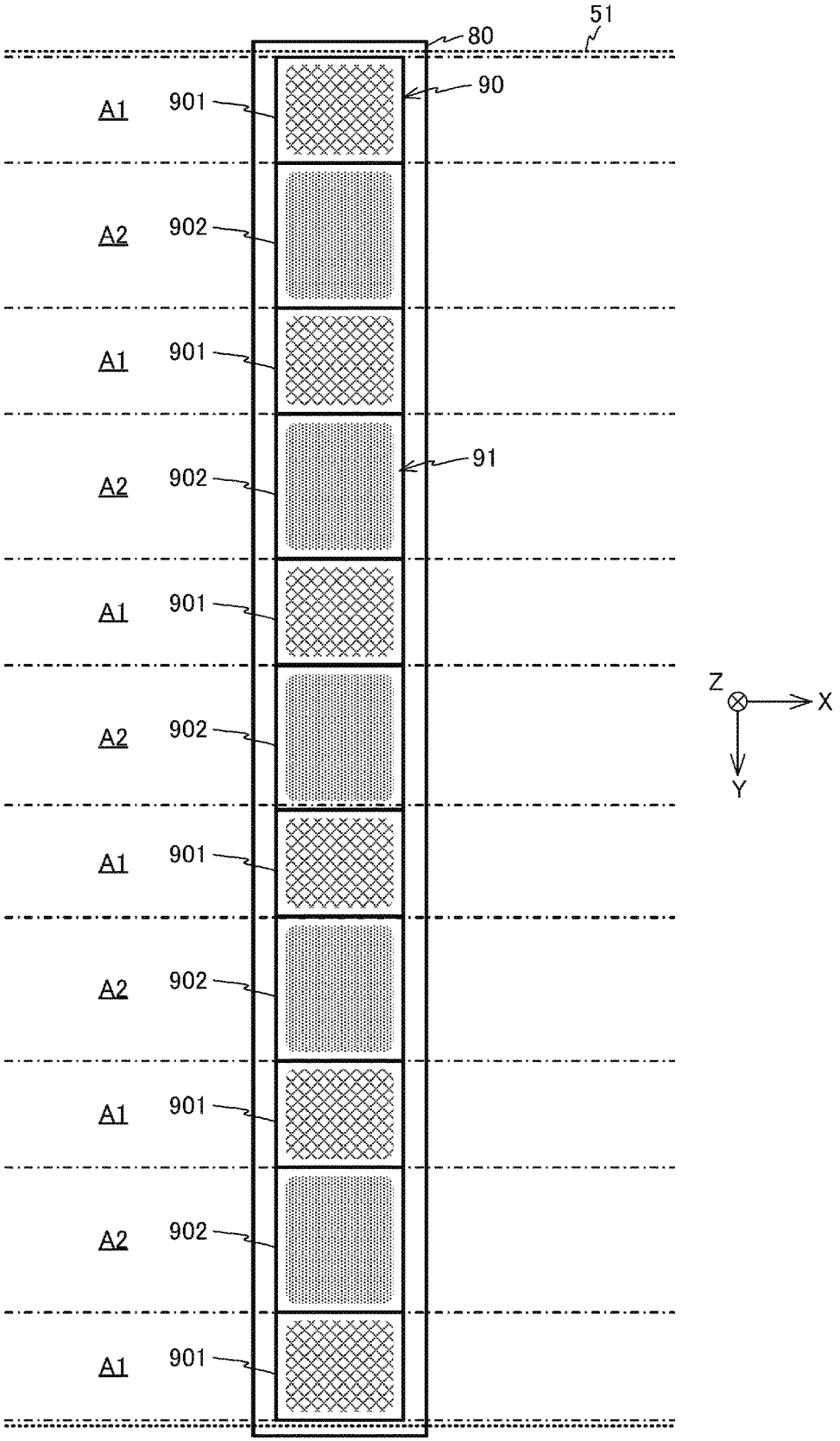
FIG. 5 is a plan view illustrating a lubricant holding member attached to a base member.

FIG. 5 is a plan view illustrating the lubricant holding member 90 attached to the base member 80. An upper surface of the lubricant holding member 90 illustrated in FIG. 5 is an abutting surface that abuts against the fixing belt 51. As illustrated in FIG. 5, an oil acting as a first lubricant is impregnated into the holding sheet 901 forming the lubricant holding member 90, and a grease acting as a second lubricant is added to the holding sheet 902. As a result, in the abutting surface of the lubricant holding member 90, a region to which the first lubricant is added and a region to which the second lubricant is added are alternately formed in the Y-axis direction.

As the oil used as the first lubricant, a silicone oil having a viscosity of about 100 cs at 100 degrees Celsius can be used. In addition, as the grease used as the second lubricant, for example, a lubricant having a viscosity of about 200 cs to 300 cs that includes a synthetic oil as a base oil can be used.

The density of the holding sheet 901 to which the first lubricant having a low viscosity is added can be set to be high, and the density of the holding sheet 902 to which the second lubricant having a high viscosity is added can be set to be low. As a result, each holding sheet can efficiently hold its respective kind of lubricant.

As illustrated in FIG. 3, in the lubricant holding member 90 having the above-described configuration, the holding sheet 901 abuts against the inner circumferential surface of the fixing belt 51 in a state where the fixing belt is elastically deformed. The holding sheet 902 is positioned adjacent to and slightly spaced from the fixing belt 51. It is preferable that the lubricant holding member 90 is disposed as close to adjacent as possible to the fixing belt 51 and the pressing pad 81. In the fixing device 50, the lubricant holding member 90 is disposed upstream of the pressing pad 81.

In the above-described fixing device 50, the halogen heater 61 is energized and heats the heating roller 60. The heating roller 60 functions to heat and warm the fixing belt 51. When the pressing roller 52 rotates, the paper P is conveyed through the nip between the pressing roller 52 and the fixing belt 51 that rotate in directions indicated by arrows in FIG. 3, respectively. As a result, the paper P is heated by the fixing belt 51, and the toner image formed on the paper P is fixed to the paper P.

When the fixing belt 51 rotates, as illustrated in FIG. 5, the first lubricant impregnated into the holding sheet 901 of the lubricant holding member 90 is applied to a region A1 of the inner circumferential surface of the fixing belt 51 through which the holding sheet 901 passes. In addition, the second lubricant impregnated into the holding sheet 902 is applied to a region A2 of the inner circumferential surface of the fixing belt 51 through which the holding sheet 902 passes.

Figure 6:
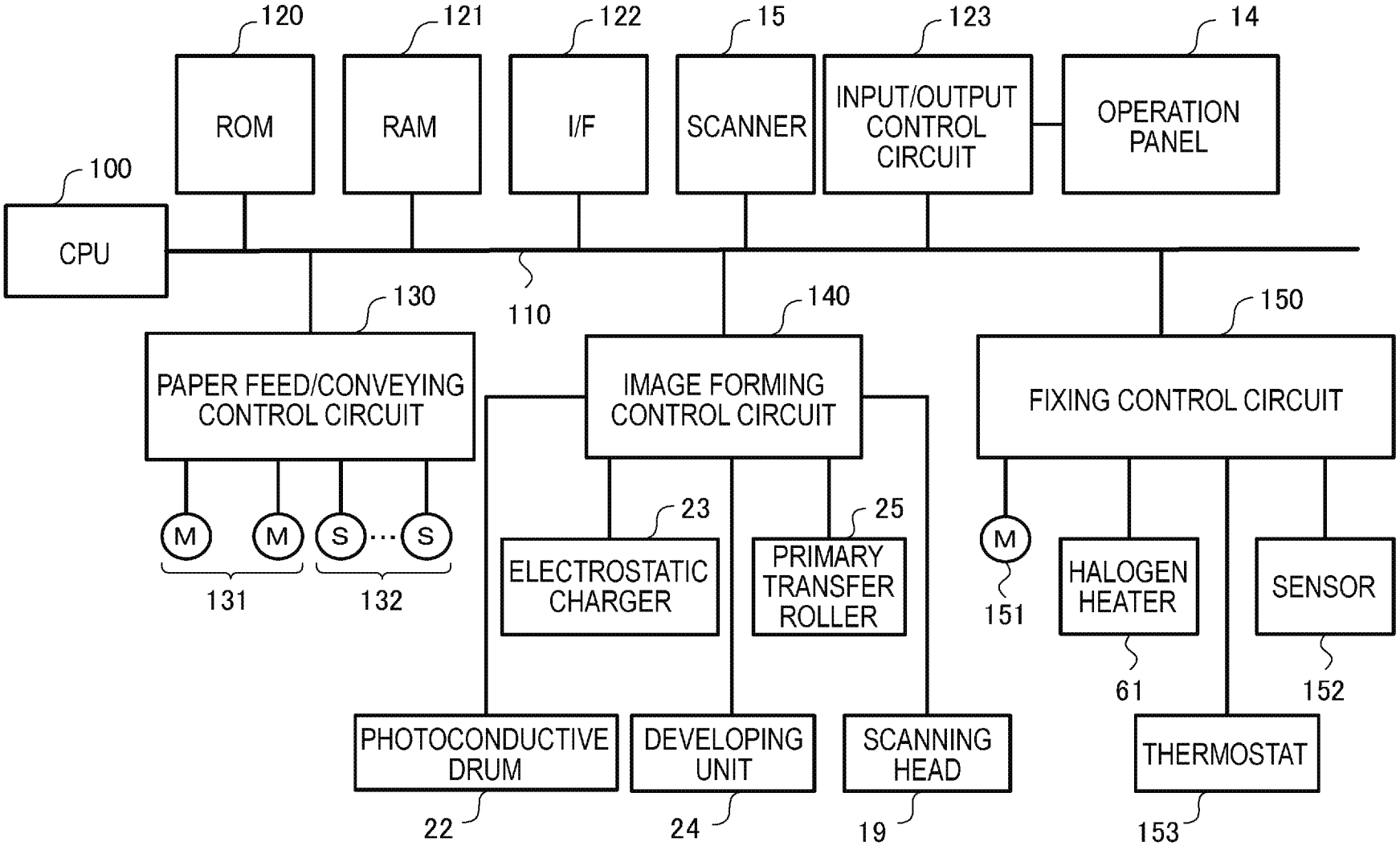
FIG. 6 is a block diagram illustrating a control system that configures an image forming apparatus.

FIG. 6 is a block diagram illustrating a control system configured to control the image forming apparatus 10 according to some embodiments. The control system includes, for example, a CPU 100 that controls the entire image forming apparatus, a bus line 110, a read-only memory (ROM) 120, a random access memory (RAM) 121, an interface 122, the scanner 15, an input/output control circuit 123, a paper feed/conveying control circuit 130, an image forming control circuit 140, and a fixing control circuit 150. The CPU 100 and each of the circuits are connected to each other through the bus line 110.

The ROM 120 stores a control program, control data, and the like that regulate a basic operation of an image forming process.

The RAM 121 functions as a working memory that is a work area of the CPU 100.

The CPU 100 executes the program stored in the ROM 120. As a result, each of the components in the image forming apparatus 10 is integrally controlled by the CPU 100 and sequentially executes processes for forming an image on paper.

The interface 122 communicates with a device such as a terminal to be used by a user. The input/output control circuit 123 displays information on the operation panel 14 or receives an input from the operation panel 14. The user of the image forming apparatus 10 can designate, for example, a paper size or the number of copies of an original document via the operation panel 14.

The paper feed/conveying control circuit 130 is a unit that controls a motor group 131 that drives the pickup roller 18*a*, the paper feed roller 35, the paper discharge roller 37 of a conveyance path, or the like. The paper feed/conveying control circuit 130 controls the motor group 131 according to a control signal from the CPU 100 or detection results of the various sensors 132 that are provided in the vicinity of the paper feed cassette 18 or in the conveyance path or the like.

The image forming control circuit 140 controls each of the photoconductive drum 22, the electrostatic charger 23, the scanning heads 19Y, 19M, 19C, and 19K, the developing unit 24, and the primary transfer roller 25 based on a control signal from the CPU 100.

The fixing control circuit 150 controls a drive motor 151 that rotates the pressing roller 52 of the fixing device 50 based on a control signal from the CPU 100, and drives the halogen heater 61 based on an output from a sensor 152 that detects the temperature of the fixing belt 51 or the size and the like of the paper P notified from the CPU. In addition, the fixing control circuit 150 stops the operation of the fixing device 50 based on a signal from a thermostat 153 that monitors overheating of the fixing belt 51.

The image forming apparatus 10 performs an image forming process for printing an image on the paper P in response to a print instruction triggered by the user. The image forming process is performed, for example, when image data received through the interface 122 is printed or when image data generated by the scanner 15 is printed.

Next, the image forming process of the image forming apparatus 10 will be described. When the print instruction from the user is received, the image forming apparatus 10 executes the image forming process for forming an image on the paper P. In the image forming process, as illustrated in FIG. 1, the paper P is drawn out from the paper feed cassette 18 by the pickup roller 18*a* and is conveyed to a gap between the intermediate transfer belt 21 and the secondary transfer roller 33 by the paper feed roller 35.

Concurrently with the above-described operation, the toner images are transferred to the photoconductive drums 22 in the image forming units 20Y, 20M, 20C, and 20K, respectively. The toner images formed on the photoconductive drums 22 in the respective image forming units 20Y, 20M, 20C, and 20K are sequentially transferred to the intermediate transfer belt 21. As a result, a toner image including the yellow (Y) toner, the magenta (M) toner, the cyan (C) toner, and the black (K) toner is formed on the intermediate transfer belt 21.

When the paper P conveyed to the gap between the intermediate transfer belt 21 and the secondary transfer roller 33 passes through the gap, the toner image formed on the intermediate transfer belt 21 is transferred to the paper P. As a result, a toner image including the toners of yellow (Y), magenta (M), cyan (C), and black (K) is formed on the paper P.

The paper P on which the toner image is formed passes through the fixing device 50. At this time, the fixing control circuit 150 controls the output of the halogen heater 61 according to the size of the paper P. The paper P is heated bypassing through the fixing device 50. As a result, the toner image transferred to the paper P is fixed to the paper P such that an image is formed on the paper P. The paper P on which the image is formed is discharged to the paper discharge unit 38 by the paper discharge roller 37. In the image forming process, the above-described process is repeated the number of times corresponding to the number of printing units.

In the fixing device 50 according to the embodiment illustrated in FIG. 4, the holding sheets 901 and 902 have different heights. The oil as the first lubricant having a low viscosity is impregnated into the holding sheet 901, and the grease as the second lubricant having a high viscosity is added to the recessed portion 91 that is formed by the holding sheets 901 and 902. As a result, as illustrated in FIG. 5, the first lubricant having a low viscosity and the second lubricant having a high viscosity are applied to the regions A1 and A2, respectively, that are alternately provided adjacent to each other in the Y-axis direction perpendicular to the moving direction of the fixing belt 51.

Therefore, the movement amount of the first lubricant that flows toward an end portion of the fixing belt 51 in Y-axis direction after being applied to the inner circumferential surface of the fixing belt 51 is small, and the outflow of the first lubricant having a low viscous resistance from the fixing belt 51 can be suppressed. As a result, sliding properties between the fixing belt 51 and the pressing pad 81 can be maintained for a long period of time without a significant increase in viscous resistance. In addition, when a buffer material such as the sliding sheet 81*a* is provided between the pressing pad 81 and the fixing belt 51, sliding properties between the buffer material and the fixing belt 51 can be maintained for a long period of time.

Accordingly, wear of the fixing belt 51 and the pressing pad 81 or wear of the fixing belt 51 and the buffer material such as the sliding sheet 81*a* can be suppressed, and the performance of the fixing device 50 can be maintained for a long period of time.

During assembly of a fixing device, a sufficient amount of a lubricant such as silicone oil is applied to an inner circumferential surface of a fixing belt. Accordingly, along with the rotation of the fixing belt, the lubricant flows out from an end portion of the fixing belt such that the amount thereof becomes insufficient. As a result, sliding properties between the fixing belt and a pressing pad deteriorate. Even when the amount of the lubricant applied during assembly of the fixing device increases, the amount of the lubricant flowing out during the operation or assembly of the device increases, and an effect of increasing the amount of the lubricant contributing to the maintaining of lubricating ability cannot be obtained. In the fixing device according to the embodiment, the lubricant can be continuously supplied, and thus the lubricating ability of the fixing belt can be maintained for a long period of time.

In addition, in the fixing device 50 according to the embodiment, the lubricant holding member 90 includes the two types of holding sheets 901 and 902. Since the lubricant holding member 90 is separated by the holding sheets 901 and 902, the mixing of the first lubricant added to the holding sheet 901 and the second lubricant added to the holding sheet 902 is suppressed. Therefore, in the lubricant holding member 90, the first lubricant and the second lubricant can be held in a state where they are separated from each other. As a result, the outflow of the first lubricant to the second lubricant applied to the fixing belt 51 can be efficiently suppressed. Accordingly, wear of the fixing belt 51 caused by friction can be suppressed, and the performance of the fixing device 50 can be maintained for a long period of time.

In the lubricant holding member 90 according to the embodiment, the density of the holding sheet 901 to which the first lubricant having a low viscosity is added is set to be high, and the density of the holding sheet 902 to which the second lubricant having a high viscosity is added is set to be low. As a result, the two kinds of lubricants can be efficiently held, with the first holding sheet holding the first lubricant and the second holding sheet holding the second lubricant.

In the fixing device 50 according to the embodiment, even when the first lubricant flows out, the first lubricant remains in the inner circumferential surface of the fixing belt 51 without the second lubricant flowing out. Accordingly, sliding properties of the fixing belt 51 can be maintained for a long period of time.

The image forming apparatus 10 according to the embodiment includes the fixing device 50. Therefore, an image can be continuously formed with high accuracy.

Figure 7:
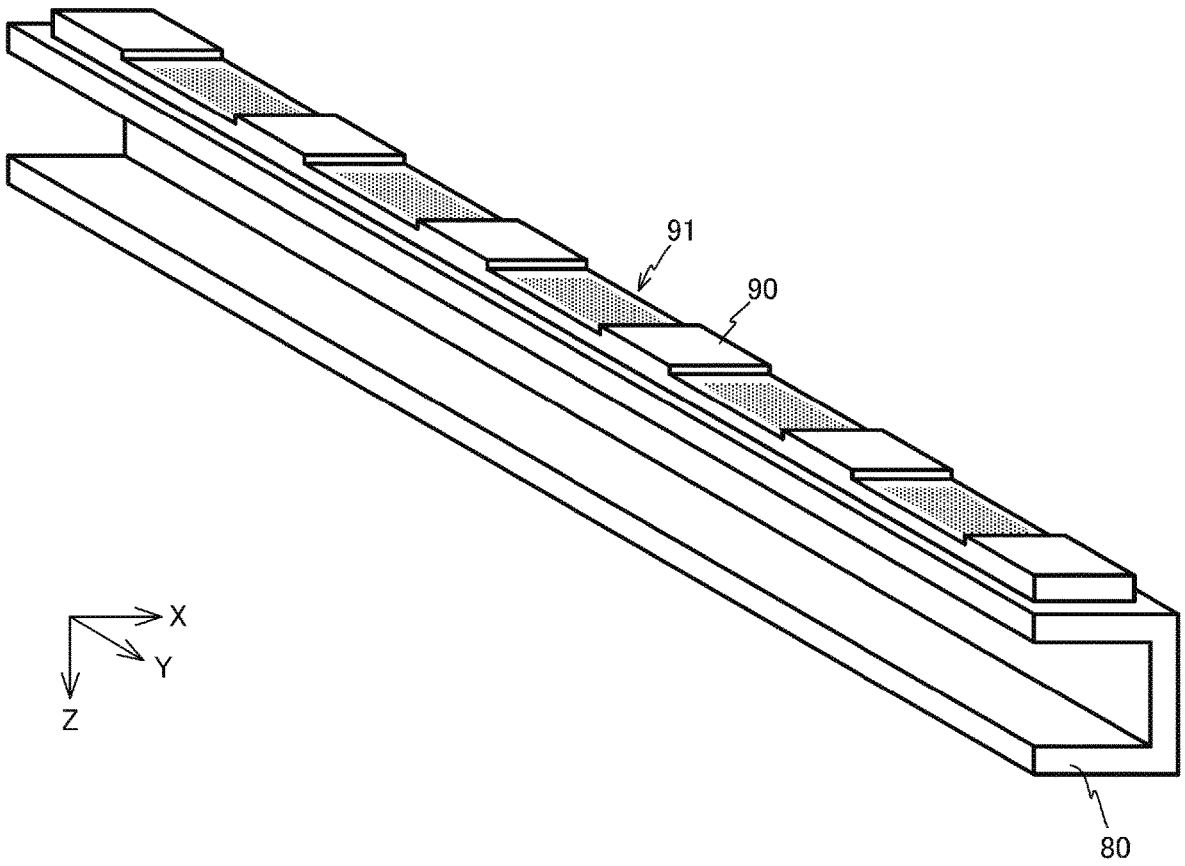
FIG. 7 is a perspective view illustrating a lubricant holding member according to a modification example.

Hereinabove, at least one embodiment has been described. However, the present disclosure is not limited to the above-described embodiment(s). For example, in the description of the above-described embodiment, as illustrated in FIG. 4, the lubricant holding member 90 includes the two kinds of holding sheets 901 and 902. However, the present disclosure is not limited to this example. As illustrated in FIG. 7, the lubricant holding member 90 may include one member. In this case, the recessed portion 91 of the lubricant holding member 90 can be filled with the second lubricant having a high viscosity, and the other portion can be impregnated with the first lubricant having a low viscosity. The first lubricant may be impregnated into the entirety of the lubricant holding member 90 or may be impregnated into a portion of the lubricant holding member other than the portion corresponding to the recessed portion 91.

Even when the lubricant holding member 90 includes one member, the first lubricant having a low viscous resistance is applied to the region A1 of the inner circumferential surface of the fixing belt 51, and the second lubricant having a high viscosity is applied to the region A2 of the inner circumferential surface of the fixing belt 51 that passes through the recessed portion 91. Accordingly, by suppressing the leakage of the first lubricant, wear of the fixing belt 51 caused by friction can be suppressed, and the performance of the fixing device 50 can be maintained for a long period of time.

In the above-described embodiment, as illustrated in FIG. 5, five recessed portions 91 are formed in the lubricant holding member 90. However, the present disclosure is not limited to this example. The lubricant holding member 90 may include four or less or six or more recessed portions 91.

In addition, in consideration of the outflow of the lubricant from both end portions of the fixing belt 51 to the outside, the recessed portions 91 may be densely disposed at both the end portions of the lubricant holding member 90 in the Y-axis direction. In addition, the dimensions of the recessed portion 91 positioned at both the ends in the Y-axis direction may be more than the dimensions of other recessed portions.

Figure 8:
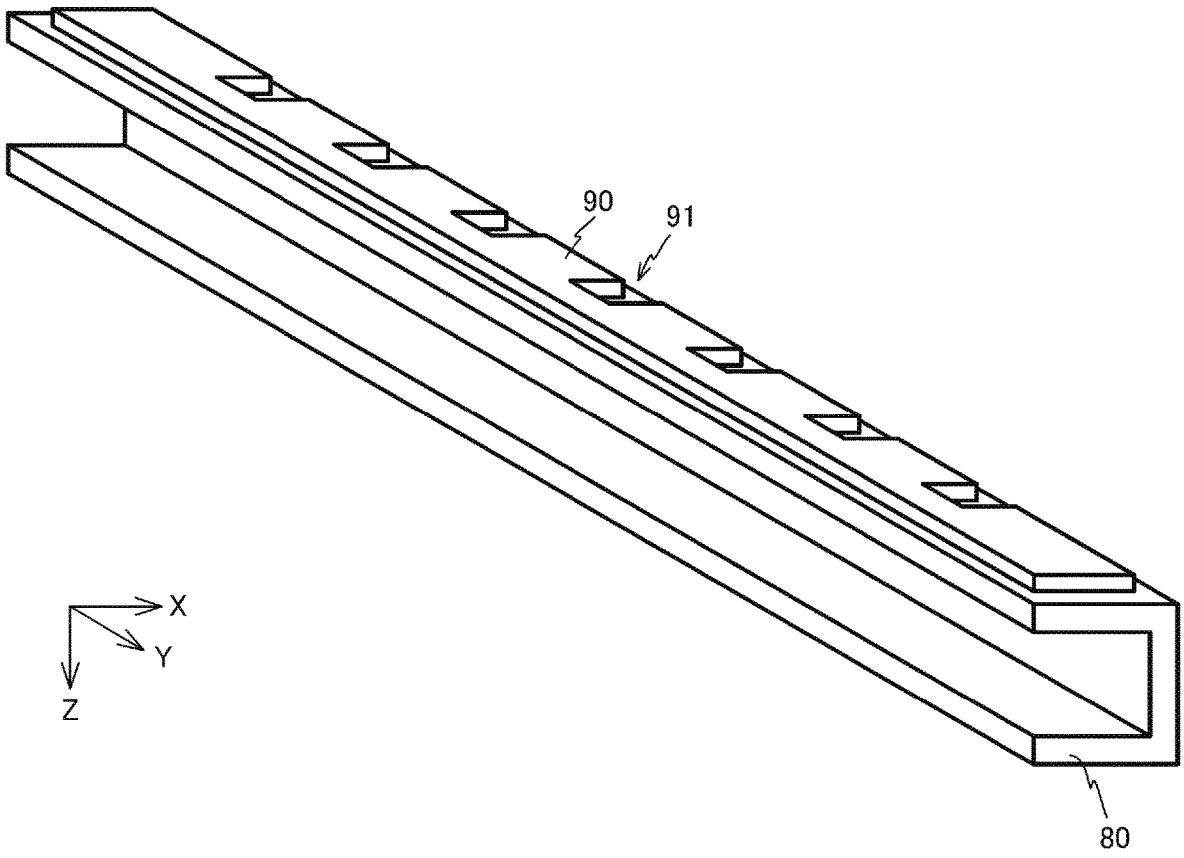
FIG. 8 is a perspective view illustrating a lubricant holding member according to a modification example.

In the above-described embodiment, as illustrated in FIG. 4, a recessed portion ranging from the abutting surface to the center portion of the lubricant holding member 90 may be formed on the abutting surface (the surface on the −Z side) of the lubricant holding member 90. However, the present disclosure is not limited to this example. As illustrated in FIG. 8, by forming a notch ranging from an outer edge to the center portion of the lubricant holding member 90, the recessed portion 91 may be formed.

In the above-described embodiment, the first lubricant is the oil, and the second lubricant is the grease. However, the present disclosure is not limited to this example. The first lubricant may be a grease instead of an oil as long as it has a viscosity of about 100 cs. Likewise, the second lubricant may be a lubricant such as an oil other than a grease as long as it has a higher viscosity than the first lubricant.

In the description of the above-described embodiment, the halogen heater 61 is used as a heat source that heats the fixing belt 51. However, the present disclosure is not limited to this example. The fixing belt 51 may be heated by electromagnetic induction using a heating coil. In addition, the fixing belt 51 may also be heated using a ceramic heater or the like.

Figure 9:
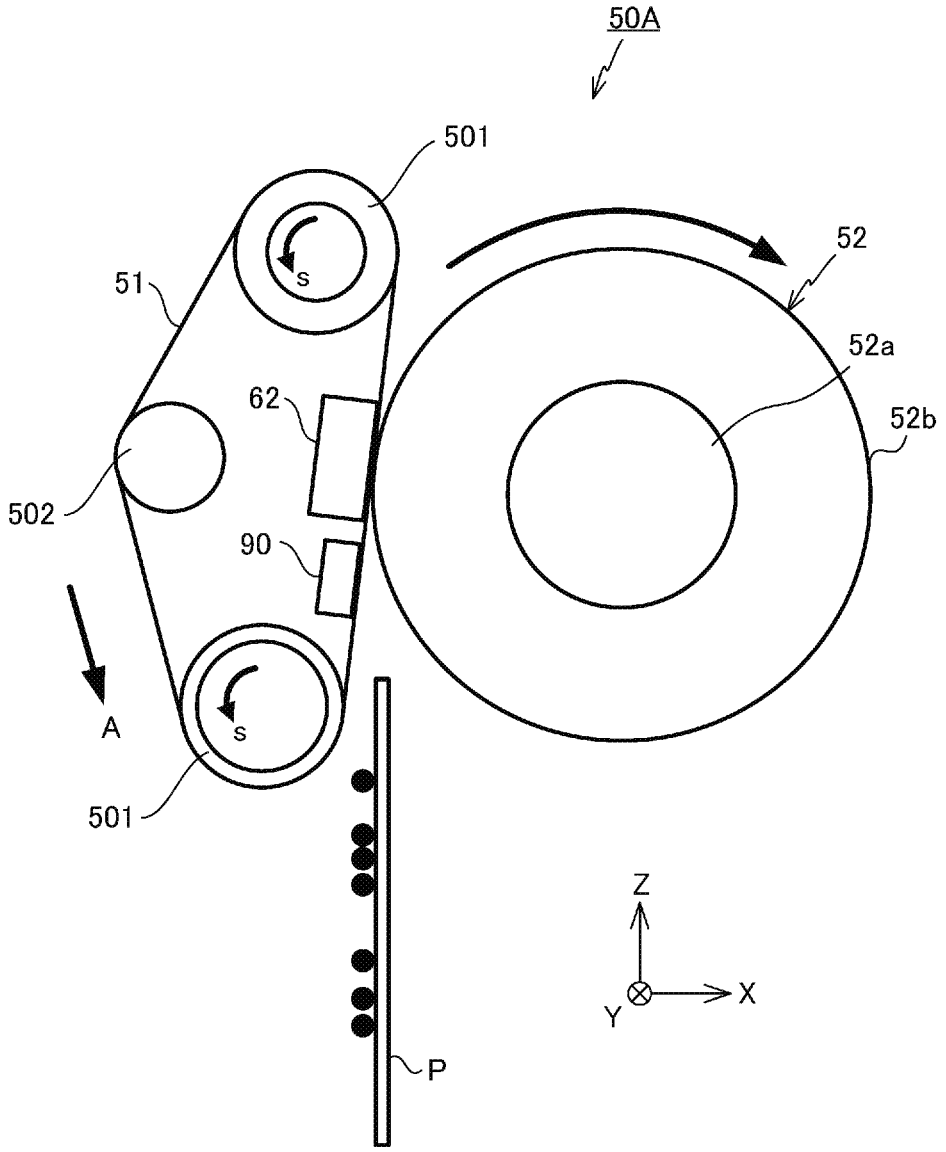
FIG. 9 is a diagram illustrating a fixing device according to a modification example.

For example, FIG. 9 illustrates a fixing device 50A in which a ceramic heater 62 is used as a heat source. As illustrated in FIG. 9, in the fixing device 50A, the fixing belt 51 is suspended by a pair of driving rollers 501 for rotating the fixing belt 51 and a tension roller 502 for applying tension to the fixing belt 51. When the driving rollers 501 rotate in a direction indicated by an arrow s, the fixing belt 51 rotates in a direction indicated by an arrow A. For example, the ceramic heater 62 includes a substrate that is formed of a ceramic and a heating unit that is formed of a resistive layer formed on the substrate. The heating unit is adjacent to the inner circumferential surface of the fixing belt 51.

In the fixing device 50A, the pressing roller 52 is pressed against the heating unit of the ceramic heater 62 adjacent to the inner circumferential surface of the fixing belt 51 through the fixing belt 51 such that a nip is formed between the fixing belt 51 and the pressing roller 52. When the paper P to which the toner image is transferred passes through a region above the nip, the paper P is heated. As a result, the toner image is fixed to the paper P such that an image is formed on the paper P.

In the description of the embodiments, the image forming apparatus 10 is a multi-function peripheral. However, the image forming apparatus 10 is not limited to this example and may be a laser printer or the like.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device configured to fix a toner image to a medium, comprising:

a heating rotating body supported to be rotatable;

a pressing member disposed at an inner circumferential surface of the heating rotating body;

a pressing rotating body configured to be pressed against the pressing member through the heating rotating body to form a nip through which the medium passes; and a lubricant holder comprising:

an abutting surface that abuts against an inner circumferential surface of the heating rotating body, the abutting surface comprising a first region configured to hold a first lubricant having a first viscosity, and a second region comprising a recessed portion configured to hold a second lubricant having a second viscosity, the second viscosity being higher than the first viscosity, a first holding portion disposed in a direction perpendicular to a rotation direction of the heating rotating body that rotates around an axis, and a second holding portion that forms the recessed portion, the second holding portion being thinner than the first holding portion.

2. The device according to claim 1, wherein the first region and the second region are alternately arranged in a direction perpendicular to the axis around which the heating rotating body rotates.

3. The device according to claim 1, wherein the first lubricant is oil, and the second lubricant is grease.

4. The device according to claim 1, wherein a viscosity of the first lubricant at 100 degrees Celsius is 100 cs.

5. The device according to claim 1, wherein a density of the first holding portion is lower than a density of the second holding portion.

6. The device according to claim 1, wherein the lubricant holder is disposed upstream of the pressing member.

7. The device according to claim 1, wherein the lubricant holder is formed of a member having liquid absorbing properties.

8. An image forming apparatus comprising:

an image forming unit configured to form a toner image;

a fixing device configured to heat a medium to fix the toner image to the medium, the fixing device comprising:

a heating rotating body supported so as to be rotatable, a pressing member being disposed at an inner circumferential surface of the heating rotating body, a pressing rotating body configured to be pressed against the pressing member through the heating rotating body to form a nip through which the medium passes, and a lubricant holder including:

an abutting surface that abuts against the inner circumferential surface of the heating rotating body, the abutting surface including a first region configured to hold a first lubricant having a first viscosity, and a second region comprising a recessed portion configured to hold a second lubricant having a second viscosity, the second viscosity being higher than the first viscosity, a first holding portion disposed in a direction perpendicular to a rotation direction of the heating rotating body that rotates around an axis, and a second holding portion that forms the recessed portion of the second region, the second holding portion thinner than the first holding portion.

9. The apparatus according to claim 8, wherein the toner image forming unit comprises a plurality of toner image forming units each configured to form an electrostatic latent image on a developing medium for transfer to a transfer medium.

10. The apparatus according to claim 9, wherein the transfer medium is an intermediate transfer belt configured to hold a primary transfer voltage for receiving the electrostatic latent image when exposed to the plurality of toner image forming units.

11. The apparatus according to claim 10, wherein the medium is configured to hold a secondary transfer voltage for receiving the toner image when exposed to the intermediate transfer belt.

12. The apparatus according to claim 8, wherein the first lubricant is oil, and the second lubricant is grease.

13. The apparatus according to claim 8, wherein a viscosity of the first lubricant at 100 degrees Celsius is 100 cs.

14. The apparatus according to claim 8, wherein the lubricant holder is disposed upstream of the pressing member.

15. The apparatus according to claim 8, wherein the lubricant holder is formed of material having liquid absorbing properties.

16. An image forming apparatus comprising:

an image forming unit configured to form a toner image;

a fixing device configured to heat a medium to fix the toner image to the medium, the fixing device comprising:

a heating rotating body supported so as to be rotatable, a pressing member being disposed at an inner circumferential surface of the heating rotating body, a pressing rotating body configured to be pressed against the pressing member through the heating rotating body to form a nip through which the medium passes, and a lubricant holder including:

an abutting surface that abuts against the inner circumferential surface of the heating rotating body, the abutting surface comprising a first region configured to hold a first lubricant having a first viscosity and a second region including a recessed portion configured to hold a second lubricant having a second viscosity, the second viscosity being higher than the first viscosity, a first holding portion disposed in a direction perpendicular to a rotation direction of the heating rotating body, and a second holding portion that forms the recessed portion of the second region, the second holding portion being thinner than the first holder portion, wherein a density of the first holding portion is lower than a density of the second holding portion.

* * * * *